US005283530A

United States Patent [19]

Uhm

[11] Patent Number: 5,283,530

[45] Date of Patent: Feb. 1, 1994

[54] ELECTRON ACCELERATION SYSTEM

[75] Inventor: Han S. Uhm, Potomac, Md.

[73] Assignee: The United States of America as represented by the Secretary of the Navy, Washington, D.C.

[21] Appl. No.: 758,978

[22] Filed: Sep. 12, 1991

[51] Int. Cl.[5] ..... H05H 1/04

[52] U.S. Cl. ..... 328/233

[58] Field of Search ..... 328/227, 233, 235; 313/62

[56] References Cited

U.S. PATENT DOCUMENTS 3,255,369 6/1966 Jacquot ..... 328/235
3,710,163 1/1973 Bomko et al. ..... 328/233 X
4,215,291 7/1980 Friedman ..... 328/233 X
4,730,166 3/1988 Birx et al. ..... 328/233

*Primary Examiner*—Sandra L. O'Shea
*Attorney, Agent, or Firm*—John D. Lewis; Jacob Shuster

[57] ABSTRACT

A bore formed within a body of material storing a magnetic field at a saturation level, establishes a linear path along which an electron beam is focussed after the bore is ionized to form a plasma channel therein. The driving current of the beam is sharply decreased to cause simultaneous decay of the stored magnetic field from a saturation level inducing an electric field concentrated in the plasma channel to accelerate travel of trailing electrons in the beam with a high accelerating gradient.

8 Claims, 2 Drawing Sheets

ELECTRON ACCELERATION SYSTEM

BACKGROUND OF THE INVENTION

This invention relates generally to the acceleration of electrically charged particles or electrons based on magnetic field decay mechanism.

Relatively recent progress has been made in electron beam accelerators of the high current type. For example, induction linear accelerator systems have been developed wherein several local accelerators apply electric fields to a cluster of traveling electrons. A time varying magnetic field is utilized in such systems to effect electron beam acceleration, wherein the accelerating gradient is proportional to the change in magnetic field flux. Most of such linear induction accelerators require ferromagnetic cores that are very bulky and heavy, as well as relatively high electric current.

It is therefore an important object of the present invention to provide an electron beam accelerator that requires less core material than heretofore deemed necessary and yet provides a higher accelerating gradient.

Further objects associated with the foregoing object of the invention, include the development of accelerators that are very compact and light, and involve use of a relatively low energy electron beam.

SUMMARY OF THE INVENTION

In accordance with the present invention, magnetic field energy is stored in a storage medium made of core material having a relatively-high magnetic permeability and low conductivity. A storage medium having such properties is selected to optimize inducement of an accelerating electric field concentrated at the axis of a bore formed in the storage medium enclosing a linear path for an electron beam. The bore is pre-ionized by a laser beam to form a plasma channel therein for efficient focussing of the beam of electrons propagated through the bore along the aforesaid linear path. Travel of the electrons along such linear path is accelerated by the electric field induced in the storage medium through an electromagnetic winding during an abrupt change in field strength of the magnetic field which occurs in response to a simultaneous drop in electric current of a low energy electron beam injected into the bore. An unexpectedly high accelerating gradient along the linear path through the bore in the storage medium is thereby established.

BRIEF DESCRIPTION OF THE DRAWING FIGURES

Other objects, advantages and novel features of the invention will become apparent from the following detailed description of the invention when considered in conjunction with the accompanying drawing wherein:

FIG. 1 a schematic illustration of an electron acceleration system in accordance with one embodiment of the invention;

FIG. 2 is a graphical illustration of the accelerating gradient establishing action associated with the system depicted in FIG. 1, and FIGS. 3 and 4 are graphical illustrations of certain relationship established by the system as depicted in FIG. 1.

DETAILED DESCRIPTION OF PREFERRED EMBODIMENT

Figure 1:
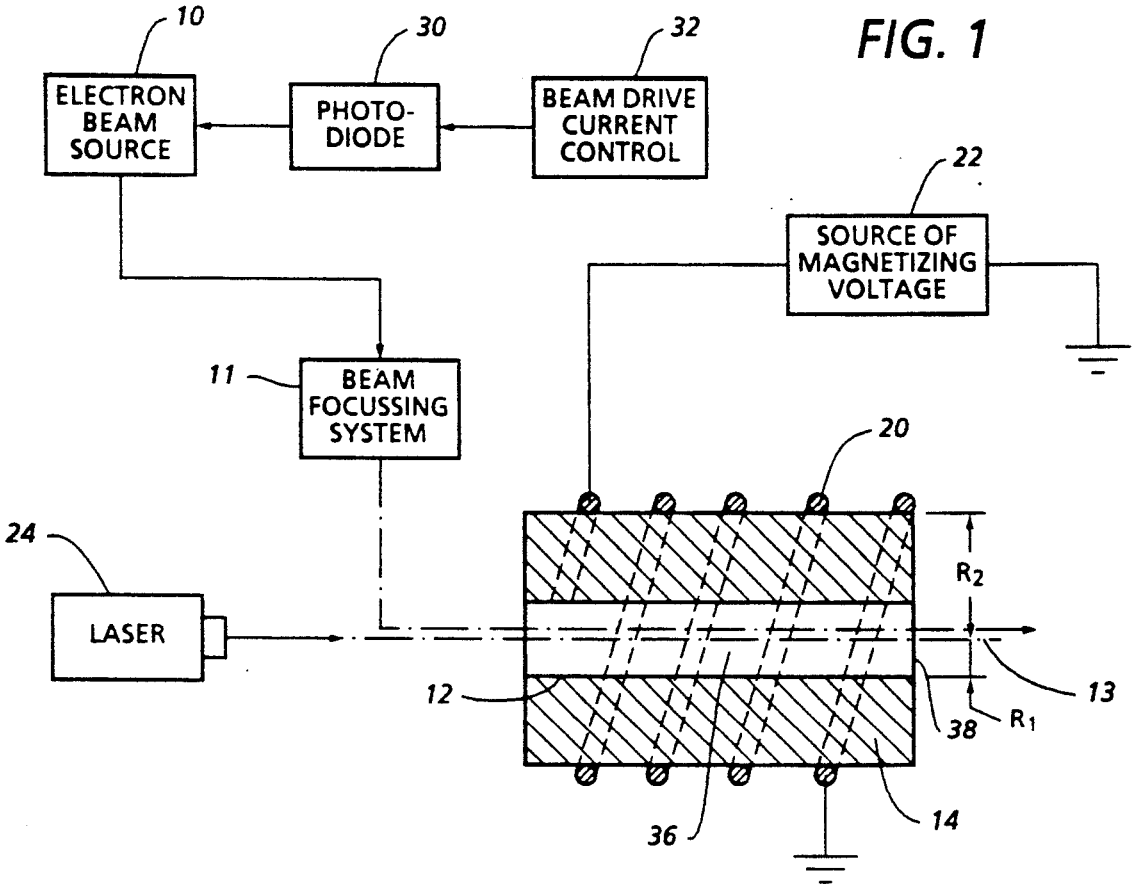

Referring now to the drawing in detail, FIG. 1 shows a source 10 from which an electron beam with current I is propagated through a bore 12 of radius $R_1$ formed in a magnetic field-energy storage medium 14 of outer radius $R_2$ relative to its axis 13. The electron beam radius is made less than the bore radius $R_1$ by a focussing system 11. The core material of the field-energy storage medium 14 within which the beam is enclosed during acceleration has a high permeability $\mu$ and a relatively low conductivity $\sigma$.

Figure 2:
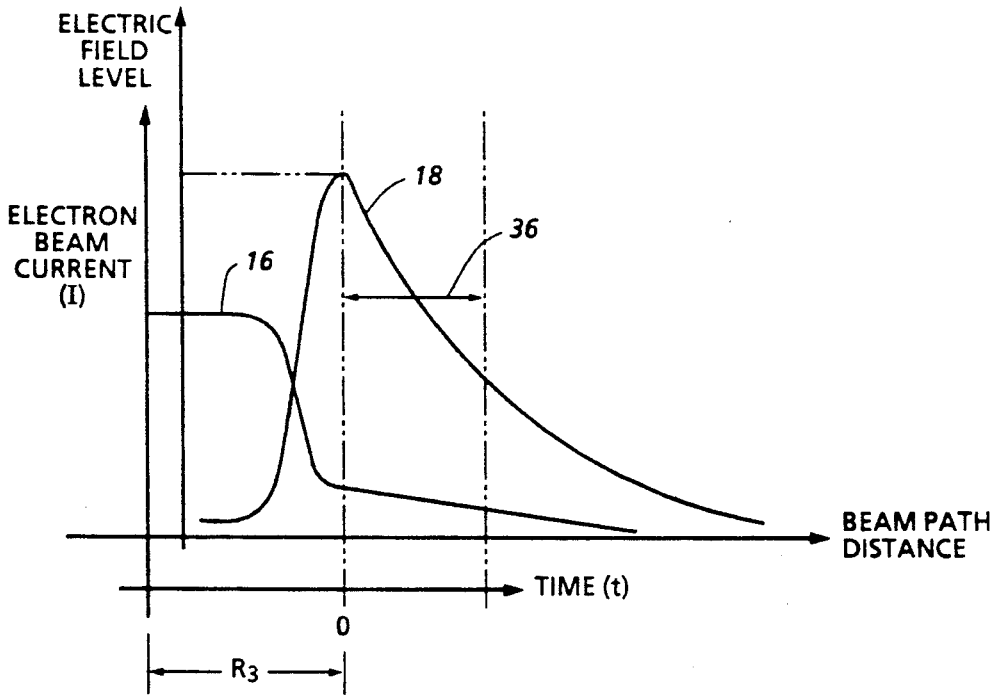

When the beam current (I) is at a constant value as shown by the flat horizontal portion of curve 16 in FIG. 2, a high concentration of the magnetic field is stored in the material of medium 14. As the beam current (I) drops abruptly to zero at time t=0 as denoted in FIG. 2, the magnetic field stored in the core material starts to decay thereby generating a strong induced-electric field along axis 13 as depicted by curve 18 in FIG. 2. This electric field accelerates a trailing beam of electrons if there is any. The Ampere's law in the Maxwell equation is written by $$\nabla \times B = \frac{\mu}{c}\frac{\partial}{\partial t}E + \frac{4\pi\mu}{c}J_T, \tag{1}$$

where B is the magnetic field. E is the electric field and $J_T$ represents both the steady-state beam current and the induced current.

In the steady-state case when t<0, the azimuthal magnetic field is approximately given by $$B_\theta{}^b(r) = \begin{cases} 2I\mu/cr, & R_1 < r < R_2, \\ 0, & \text{otherwise} \end{cases} \tag{2}$$

where the magnetic field outside the storage material is neglected simply because of a large value of the permeability of the material. The superscript b in Eq. (2) represents the time before t=0 as diagrammed in FIG. 2. The azimuthal magnetic field after t=0 is obtained from the Maxwell equation.

$$\frac{\partial}{\partial r}\left[\frac{1}{r}\frac{\partial}{\partial r}\left(r\frac{B_\theta{}^a}{\mu}\right)\right] - \frac{4\pi\sigma}{c^2}\frac{\partial B_\theta{}^a}{\partial t} - \frac{\epsilon}{c^2}\frac{\partial^2 B_\theta{}^a}{\partial t^2} = 0, \tag{3}$$

where $\epsilon$ is the dielectric constant and use made of the induced current density $J_{in}=\sigma E_z(r,t)$. Most of the azimuthal magnetic field is concentrated inside the field-storage material. We therefore neglect other regions.

Assuming that the most dominant radial wavevector k is in the order of $1/R_1$ in magnitude, it is recognized that the third term in Eq. (3) is negligible, provided $$4\pi\sigma\sqrt{\mu/\epsilon}R_1 >> c, \tag{4}$$

which can be easily satisfied in practical cases.

The azimuthal magnetic field $B_\theta{}^a(r,t)$ in the range of $R_1<r<R_2$ is given by $$B_\theta{}^a(r,t) = \int_0^\infty dk a_k J_1(kr)\exp(-\lambda_k{}^2 t), \tag{5}$$

where $J_\alpha(x)$ is the Bessel function of order $\alpha$, k is the radial wavevector the parameter $\Delta_k$ defined by $$\lambda_k^2 = \frac{k^2c^2}{4\pi\sigma\mu}, \tag{6}$$

and the coefficient $a_k$ must satisfy $$\int_0^\infty dk a_k J_1(kr) = B_\theta^b(r). \tag{7}$$

Substituting Eq. (2) into Eq. (7), multiplying both sides of Eq. (7) by $rJ_1(kr)$ and making use of the orthogonality of the Bessel function, the following equation is obtained:

$$a_k = \frac{2I\mu}{C}[J_0(kR_1) - J_0(kR_2)]. \tag{8}$$

Substitution of Eq. (8) into Eq. (5) gives a complete expression of the magnetic field inside the field storage material, neglecting the magnetic field outside the storage material The induced-electric field $E_z(r,t)$ is obtained from the relationship $$\frac{\partial E}{\partial r} z = \frac{1}{c}\frac{\partial B_\theta^a}{\partial t}, \tag{9}$$

where use has been made of the approximation $\gamma=1$. substituting Eqs. (5) and (8) into Eq. (9), the induced - electric field at the axis 13 is expressed as $$E_z(t) = \frac{2I\mu}{c^2}\int_0^\infty \frac{dk}{k}\lambda_k^2\exp(-\lambda_k^2 t)\cdot[J_0(kR_1) - J_0(kR_2)]^2. \tag{10}$$

Carrying out the integration over k space in Eq. (10), the induced-electric field at the axis 13 is finally given by $$E_z(t) = \frac{1}{2\pi\sigma R_1^2\tau}\left[\exp\left(-\frac{1}{\tau}\right)I_0\left(\frac{1}{\tau}\right) + \exp\left(-\frac{1}{\tau}\frac{R_2^2}{R_1^2}\right)I_0\left(\frac{1}{\tau}\frac{R_2^2}{R_1^2}\right) - 2\exp\left(-\frac{1+R_2^2/R_1^2}{2\tau}\right)I_0\left(\frac{1}{\tau}\frac{R_2}{R_1}\right)\right], \tag{11}$$

where the dimensionless time $\tau$ is defined by $$\tau = \frac{c^2 t}{2\pi\sigma\mu R_1^2} \tag{12}$$

Figure 3:
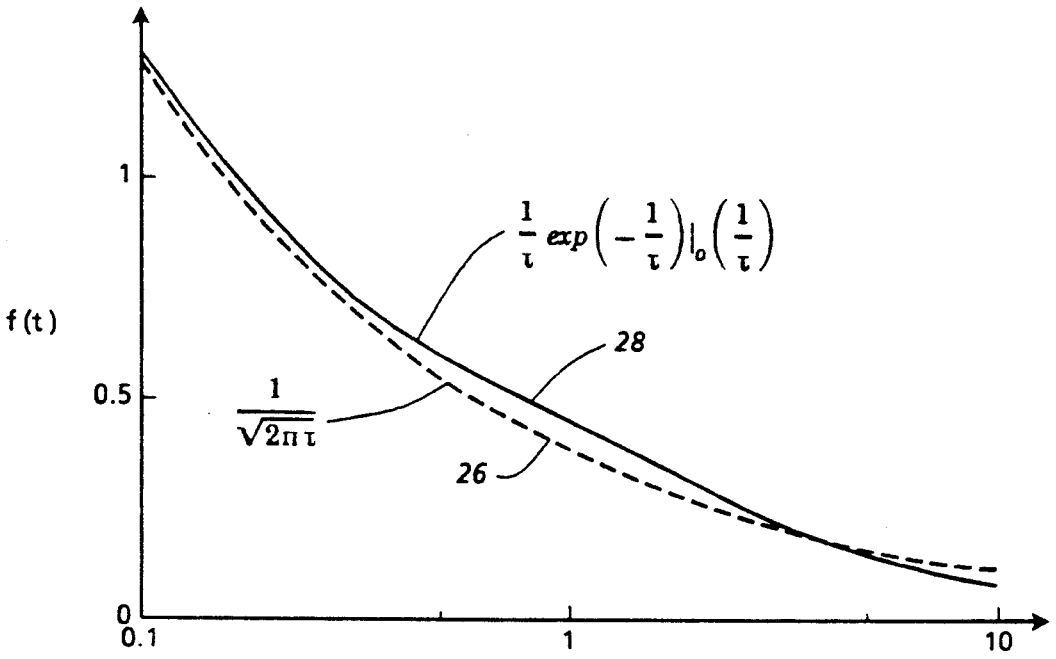

The contributions of the second and third terms in the right-hand side of Eq. (11) is less than 7 percent if the parameter $R_2/R_1>3$ in a practical application. Thus, Eq. (11) is simplified to $$E_z(t) = \frac{I}{2\pi\sigma R_1^2}\frac{1}{\tau}\exp\left(-\frac{1}{\tau}\right)I_0\left(\frac{1}{\tau}\right), \tag{13}$$

as reflected by solid line curve 28 in FIG. 3. Where $\tau<10$, eq. (13) is further simplified to:

$$E_z(t) = \frac{I}{2\pi\sigma R_1^2}\frac{1}{\sqrt{2\pi\tau}}, \tag{14}$$

which is represented by dotted line curve 26 in FIG. 3. The induced field as determined from Eq. (14) is a monotonically decreasing function of the normalized time $\tau$ as indicated by dotted line curve 26 in FIG. 3. It will be recalled that Eq. (14) has been derived under the assumption that the driving-beam current I drops abruptly to zero at $t=0$. The falling time of the driving-beam current is probably small. In reality, there is a finite beam-falling time, which will determine values of the normalized time $\tau$. If the driving-beam current I is extracted from photo-cathode 30 as diagrammed in FIG. 1, the rising and falling times of the driving beam current I can be controlled reasonably well through a control 32.

Figure 4:
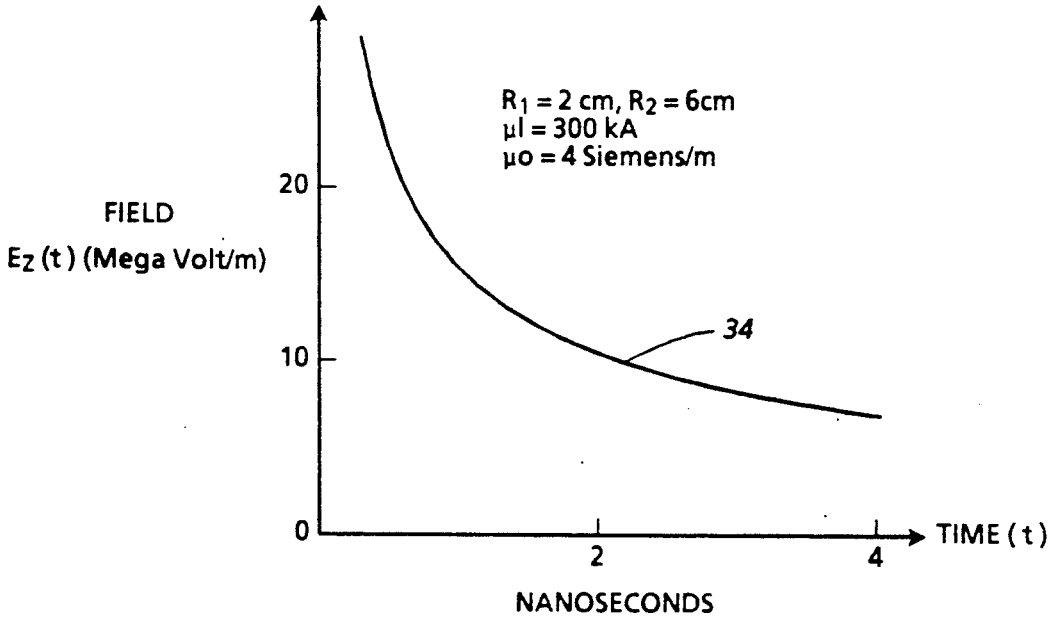

The magnetic field as determined from Eq. (2) at $r=R_1$ before the time of $t=0$, increases with the parameter $\mu I$ until the saturation value is achieved, which is one of the characteristic properties of the field-storage material. In other words, the maximum value of the parameter $\mu I$ is limited by the magnetic-field saturation value of the core material. For example, the saturation value of the core magnetic field for some iron alloys is 15 kG, whereas the field saturation value in a vacuum is undefined. The saturation value of the magnetic field may be increased to a large value. For example, a field-storage medium 14 having inner and outer radii of $R_1=2$ cm and $R_2=6$ cm, respectively has been investigated. The strength of the induced-electric field $E_z(t)$ at the axis 13 is calculated from Eq. (11). FIG. 4 graphically depicts in curve 34 the accelerating gradient field versus the normalized time $\tau$ for $\mu\sigma=4$ siemens/m and $\mu I=300$ kA, which corresponds to the saturation magnetic field of 30 kG at a radius $r=R_1=2$ cm. The normalized time $\tau$ is related to the real t by $\tau=1$ (in units of nano-second) for $R_1=2$ cm and $\mu\sigma=4$ siemens/m. In a reasonably-practical parameter regime, the accelerating field is easily more than 10 mega volt/meter, which is one order in magnitude larger than the conventional accelerating field. In addition, the system as diagrammed in FIG. 1 is very compact and light.

The saturation value of the magnetic field should be larger than 15 kG to be practical for high-gradient fields and the storage material of medium 14 must withstand a high breakdown field. Also, the magnetic field must decay quickly. The microscopic domains of the magnetic material should be arranged in such a way that the macroscopic field must be zero. The magnetic moments in each domain rotates within a subnanosecond time scale.

The material medium 14 must also have a large value of permeability with a reasonably small conductivity. As an example, for $\mu I=300$ kA and $\mu\sigma=4$ siemens/m in FIG. 4, the driving-beam current $I=750$ A and conductivity $\sigma$ is $10^{-2}$ siemens/m for the permeability $\mu=400$. The conductivity $\sigma=10^{-2}$ siemens/m is very close to the conductivity of limestone. There is no single element to satisfy the foregoing conditions so that a composite of several different elements may satisfy the necessary conditions. The dielectric constant or permeability of heterogeneous mixtures can be determined from the functional form $$v_2 = \frac{\mu_1^{\frac{1}{3}} - \mu^{\frac{1}{3}}}{\mu_1^{\frac{1}{3}} - \mu_2^{\frac{1}{3}}}, \quad (15)$$

where $V_2$ is the volume fraction of the dispersed component, $\mu_2$ is the permeability of the component, $\mu_1$ is the permeability of the other component and $\mu$ is the desired permeability of the field-storage material.

It will be apparent from the foregoing that a high-current electron beam with relatively low energy propagates through the hole 12 bored along the field-storage medium 14 and is confined thereto by the axial magnetic field produced by winding 20 connected to voltage source 22. While the magnetic field may not penetrate very well through the high permeability material of medium 14, the ion focused regime (IFR) propagation of a photo-ionizing electron beam from laser source 24 partially neutralizes the space charge field of the electron beam in hole 12 thereby permitting a focused beam from source 10. Such IFR propagation of a relativistic electron beam results from prior ionization of gas within bore 12 by laser 24 forming a plasma channel therein.

Based on the foregoing description, the electron accelerating system of the present invention makes use of the accelerating-electric field along a high particle acceleration region 36 having an exit port end 38 and corresponding to the linear path formed within bore 12. Such region 36 is graphically depicted by curve 18 in FIG. 2. Generation of the accelerating electric field depicted along curve 18, is initiated by an abrupt change of the magnetic field stored in material 14. Based on a high permeability for material 14, Eq. (14) indicates that the accelerating-electric field can be easily a substantial fraction of mega volt/cm.

Numerous other modifications and variations of the present invention are possible in light of the foregoing teachings. It is therefore to be understood that within the scope of the appended claims the invention may be practiced otherwise than as specifically described.

What is claimed is:

1. In a method of accelerating travel of electrons through a body of material within which a magnetic field is stored, by inducing therein an electric field in response to change in strength of said magnetic field to thereby establish an accelerating gradient along a linear path through said body of material, the improvement residing in the steps of: generating a beam of electrons of a substantially constant driving current; projecting said beam of electrons through said body of material along said linear path to increase in strength the magnetic field stored within the body of material toward a saturation level; abruptly decreasing said constant driving current of the beam to cause decay in the strength of the magnetic field from said saturation level during said travel of the electrons along said linear path; ionizing gas within the body of material along said linear path to form a plasma channel; and focussing the beam to dimensionally confine said travel of the electrons to said plasma channel.

2. The improvement as defined in claim 1 wherein said linear path is established by formation of a bore within said body of material to which the beam of electrons is dimensionally confined by the magnetic field.

3. The improvement as defined in claim 2 wherein the saturation level of the magnetic field is greater than 15 kG.

4. The method of claim 1 wherein the saturation level of the magnetic field is greater than 15 kG.

5. In a method of accelerating travel of electrons through a body of material within a magnetic field by means of an electric field induced therein by change in strength of said magnetic field to establish an accelerating gradient along a linear path formed in said body of material, the improvement residing in the steps of: ionizing gas within the body of material along said linear path to form a plasma channel; generating a beam of sad electrons dimensionally focussed to confine said travel of the electrons within said plasma channel; and abruptly decreasing driving current of the focussed beam to effect decay in strength of the magnetic field stored within the body material and establish said accelerating gradient along the plasma channel.

6. The method of claim 5 wherein said step of generating the beam includes: initially maintaining the driving current at a substantially constant value during which the magnetic field stored within the body of material reaches a saturation level from which said decay in strength occurs.

7. An electron beam accelerator, comprising: a generator of electrons, means for enclosing a region in communication with said generator, means for accelerating the electrons within a beam supplied to the region from the generator and means for generating a plasma in said region through which the electrons in said beam are accelerated, said means for enclosing the region having an exit port through which the electrons are extracted.

8. The combination of claim 7 wherein said means for enclosing the region is an energy storage medium having a bore through which the region extends terminating at said exit port and means for establishing a magnetic field stored within the storage medium, said means for accelerating the electrons comprising control means operatively connected to said generator for inducing rapid decay of the magnetic field.

* * * * *